US007928930B2

(12) United States Patent
Cho et al.

(10) Patent No.: US 7,928,930 B2
(45) **Date of Patent: *Apr. 19, 2011**

(54) PLASMA DISPLAY APPARATUS

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 879 days.

This patent is subject to a terminal disclaimer.

(21) Appl. No.: 11/854,247

(22) Filed: Sep. 12, 2007

(65) Prior Publication Data

US 2008/0062078 A1 Mar. 13, 2008

(30) Foreign Application Priority Data

Sep. 12, 2006 (KR) ..... 10-2006-0088306

(51) Int. Cl.
*G09G 3/28* (2006.01)

(52) U.S. Cl. ..... 345/63; 345/60

(58) Field of Classification Search ..... 345/60–70; 315/169.1–169.4

See application file for complete search history.

(56) References Cited

U.S. PATENT DOCUMENTS

| | | | | |
|---|---|---|---|---|
| 5,566,064 | A * | 10/1996 | Schoenwald et al. | 363/132 |
| 5,874,828 | A * | 2/1999 | Lee | 323/274 |
| 2006/0103325 | A1 | 5/2006 | Kim | |

FOREIGN PATENT DOCUMENTS

| | | | |
|---|---|---|---|
| EP | 1 018 722 | A1 | 7/2000 |
| EP | 1 467 342 | A2 | 10/2004 |
| KR | 10-2005-0112851 | A | 12/2005 |
| KR | 10-2005-0113858 | A | 12/2005 |

* cited by examiner

*Primary Examiner* — Ricardo L Osorio
(74) *Attorney, Agent, or Firm* — Birch, Stewart, Kolasch & Birch, LLP

(57) ABSTRACT

A plasma display apparatus is disclosed. The plasma display apparatus includes a first driver, a third driver, and a separation controller. The first driver supplies a driving signal to a first electrode of a plasma display panel during a reset period, an address period and a sustain period and is electrically connected to a first reference voltage source. The third driver supplies a data signal to a third electrode of the plasma display panel during the address period and is electrically connected to a second reference voltage source. The separation controller controls the electrical separation between the first reference voltage source and the second reference voltage source during at least one period of the reset period, the address period or the sustain period.

20 Claims, 12 Drawing Sheets

PLASMA DISPLAY APPARATUS

This application claims the benefit of Korean Patent Application No. 10-2006-0088306 filed on Sep. 12, 2006, which is hereby incorporated by reference.

BACKGROUND OF THE DISCLOSURE

1. Field of the Disclosure

This document relates to a plasma display apparatus.

2. Description of the Background Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY OF THE DISCLOSURE

A plasma display apparatus comprises a plasma display panel including a first electrode, a second electrode, and a third electrode positioned in an intersection direction of the first electrode and the second electrode, a first driver that supplies a driving signal to the first electrode during a reset period, an address period and a sustain period, and is electrically connected to a first reference voltage source, a third driver that supplies a data signal to the third electrode during the address period, and is electrically connected to a second reference voltage source, and a separation controller that controls the electrical separation between the first reference voltage source and the second reference voltage source during at least one period of the reset period, the address period or the sustain period.

The plasma display apparatus may further comprise a second driver that supplies a driving signal to the second electrode during the address period and the sustain period, and is electrically connected to the first reference voltage source.

The separation controller may control the electrical separation between the first reference voltage source and the second reference voltage source during the reset period.

The first driver may include a setup driver that supplies a gradually rising signal to the first electrode during the reset period, a set-down driver that supplies a gradually falling signal to the first electrode during the reset period, a scan reference voltage supply unit that supplies a scan reference voltage to the first electrode during the address period, a scan signal supply unit that supplies a scan signal to the first electrode during the address period, a first sustain supply unit that supplies a sustain signal to the first electrode during the sustain period, and a second sustain supply unit that supplies a sustain signal to the second electrode during the sustain period.

The third driver may include a data driver supplying the data signal to the third electrode. The data driver may include a top switch supplying a data voltage of the data signal to the third electrode during the address period, and a bottom switch supplying a second reference voltage output from the second reference voltage source to the third electrode during the address period.

The separation controller may include a first switch whose one terminal is electrically connected to the first reference voltage source, and a second switch whose one terminal is electrically connected to the first switch and the other terminal is electrically connected to the second reference voltage source.

The first and second switches may each include an internal diode, and a forward direction of the internal diode of the first switch may be opposite to a forward direction of the internal diode of the second switch.

The separation controller may include a separation control switch whose one terminal is electrically connected to the first reference voltage source, and a diode whose one terminal is electrically connected to the other terminal of the separation control switch and the other terminal is electrically connected to the second reference voltage source.

The separation controller may include a separation control switch whose one terminal is electrically connected to the second reference voltage source, and a diode whose one terminal is electrically connected to the other terminal of the separation control switch and the other terminal is electrically connected to the first reference voltage source.

The separation control switch may include an internal diode, and a forward direction of the internal diode of the separation control switch may be opposite to a forward direction of the diode.

The first driver may supply a sustain signal including a positive sustain voltage and a negative sustain voltage to the first electrode during the sustain period.

The separation controller may control the electrical separation between the first reference voltage source and the second reference voltage source during the reset period and the sustain period.

The third driver may include a data driver supplying the data signal to the third electrode. The data driver may include a top switch supplying a data voltage of the data signal to the third electrode during the address period, and a bottom switch supplying a second reference voltage output from the second reference voltage source to the third electrode during the address period.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
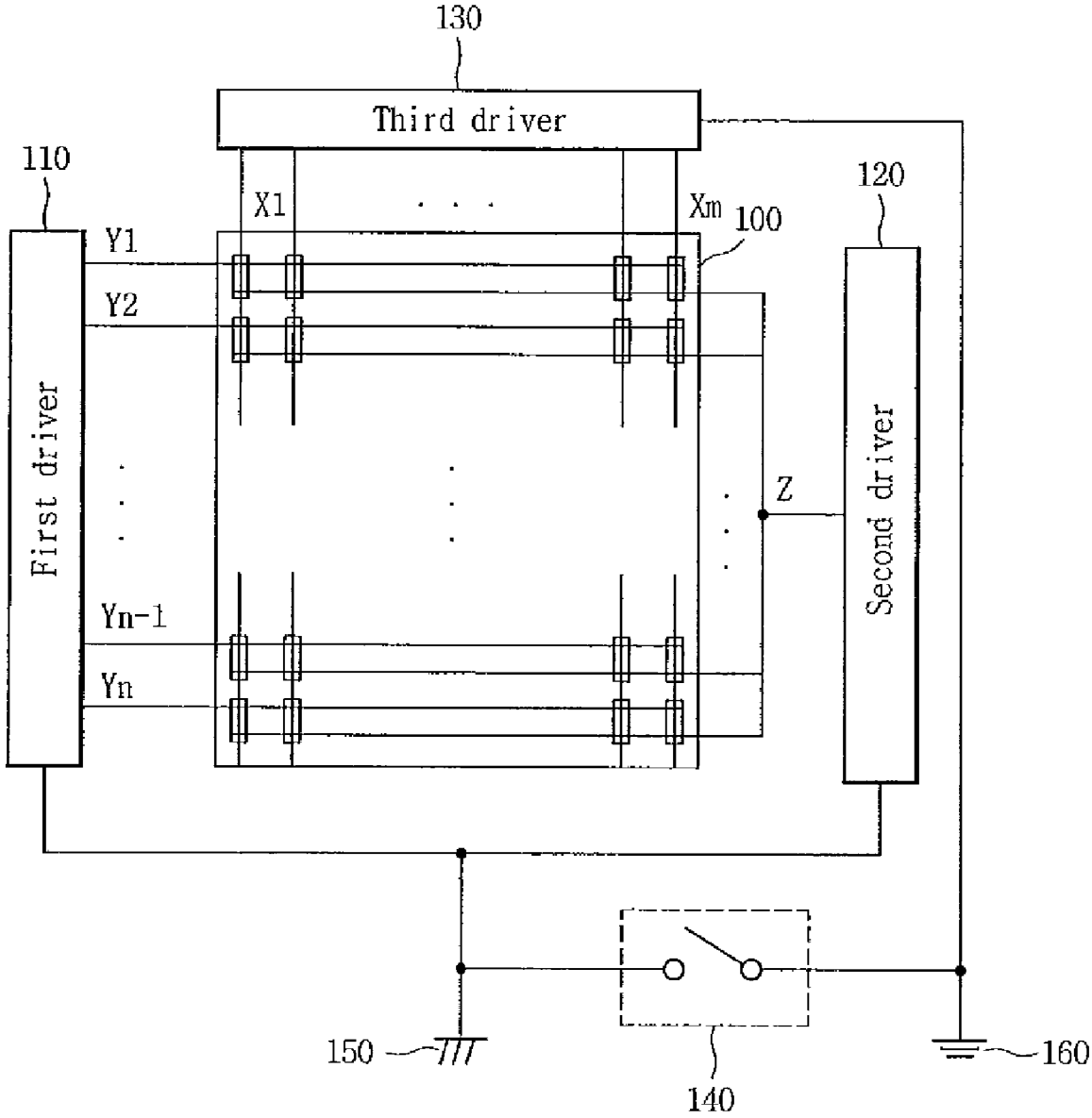
FIG. 1 illustrates an implementation of a plasma display apparatus according to an exemplary embodiment.

FIG. 1 illustrates an implementation of a plasma display apparatus according to an exemplary embodiment.

As illustrate in FIG. 1, the plasma display apparatus according to an exemplary embodiment includes a plasma display panel 100, a first driver 110, a second driver 120, a third driver 130, and a separation controller 140.

The plasma display panel 100 includes first electrodes Y1 to Yn, second electrodes Z, and third electrodes X1 to Xm positioned in an intersection direction of the first electrodes Y1 to Yn and the second electrodes Z.

The first driver 110 supplies driving signals to the first electrodes Y1 to Yn during a reset period, an address period, and a sustain period. For instance, the first driver 110 may supply at least one of a setup signal or a set-down signal, a scan reference voltage and a scan signal, and a sustain signal for a sustain discharge to the first electrodes Y1 to Yn during a reset period, an address period, and a sustain period, respectively.

Instead of the scan reference voltage, a scan bias voltage having a sum of the scan reference voltage and a lowest voltage of the scan signal may be supplied to the first electrodes Y1 to Yn.

The first driver 110 is electrically connected to a first reference voltage source 150, and driving voltage sources for supplying driving signals to the first driver 110 are electrically connected to the first reference voltage source 150.

The second driver 120 supplies a driving signal during a sustain period. For instance, the second driver 120 may supply a sustain signal to the second electrodes Z during a sustain period so that the sustain signal supplied by the first driver 110 and the sustain signal supplied by the second driver 120 are alternately supplied. Driving voltage sources for supplying driving signals to the second driver 120 are electrically connected to the first reference voltage source 150. Further, the second driver 120 is electrically connected to the first reference voltage source 150 in the same way as the first driver 110.

The third driver 130 supplies a data signal during an address period. For instance, the third driver 130 supplies a video data signal input from the outside to the third electrodes X1 to Xm during an address period. The third driver 130 is electrically connected to a second reference voltage source 160.

The separation controller 140 is electrically connected between the first reference voltage source 150 and the second reference voltage source 160 to control the electrical separation or the electrical connection between the first reference voltage source 150 and the second reference voltage source 160 during at least one period of a reset period, an address period or a sustain period.

For instance, the separation controller 140 can electrically separate the first reference voltage source 150 from the second reference voltage source 160 during a reset period. The separation controller 140 can electrically separate the first reference voltage source 150 from the second reference voltage source 160 during the remaining period excluding a supply period of a positive sustain voltage to the first electrodes Y1 to Yn from a sustain period.

When the first reference voltage source 150 is separated from the second reference voltage source 160, a voltage difference between the first electrodes Y1 to Yn and the third electrodes X1 to Xm or a voltage difference between the second electrodes Z and the third electrodes X1 to Xm slightly increases in spite of the fact that a voltage difference between the first electrodes Y1 to Yn and the second electrodes Z greatly increases. Accordingly, an opposite discharge between the first electrodes Y1 to Yn and the third electrodes X1 to Xm or between the second electrodes Z and the third electrodes X1 to Xm can be suppressed. Further, a damage to a phosphor is reduced due to the suppression of the opposite discharge, and life span of the plasma display apparatus increases.

Figure 2:
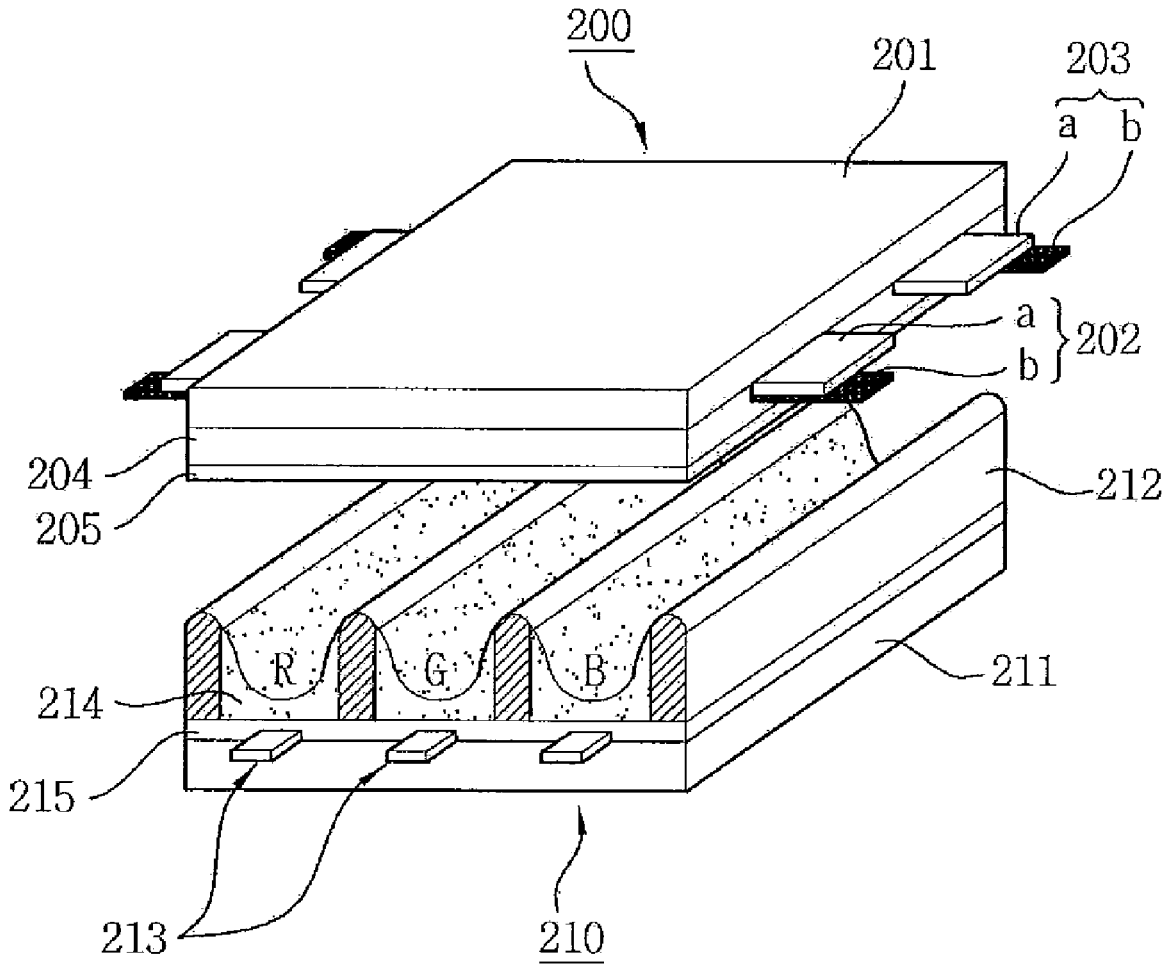
FIG. 2 illustrates a structure of a plasma display panel of FIG. 1.

FIG. 2 illustrates a structure of the plasma display panel 100 of FIG. 1.

As illustrated in FIG. 2, the plasma display panel 100 includes a front panel 200 and a rear panel 210 which are coupled parallel to each other to oppose to each other at a given distance therebetween. The front panel 200 includes a front substrate 201 being a display surface on which an image is displayed. The rear panel 210 includes a rear substrate 211 constituting a rear surface. A plurality of first electrodes 202 and a plurality of second electrodes 203 are formed in pairs on the front substrate 201. A plurality of third electrodes 213 are arranged on the rear substrate 211 to intersect the first electrodes 202 and the second electrodes 203.

The first electrode 202 and the second electrode 203 each include transparent electrodes 202*a* and 203*a* made of a transparent material, for instance, indium-tin-oxide (ITO) and bus electrodes 202*b* and 203*b* made of a metal material. The first electrode 202 and the second electrode 203 generate a mutual discharge therebetween in one discharge cell and maintain light-emissions of the discharge cells. The first electrode 202 and the second electrode 203 are covered with one or more upper dielectric layers 204 for limiting a discharge current and providing electrical insulation between the first electrode 202 and the second electrode 203. A protective layer 205 with a deposit of MgO is formed on an upper surface of the upper dielectric layer 204 to facilitate discharge conditions.

A plurality of stripe-type (or well-type) barrier ribs 212 are formed in parallel on the rear substrate 211 to form a plurality of discharge spaces (i.e., a plurality of discharge cells). The plurality of third electrodes 213 for performing an address discharge to generate vacuum ultraviolet rays are arranged parallel to the barrier ribs 212. An upper surface of the rear substrate 211 is coated with red (R), green (G) and blue (B) phosphors 214 for emitting visible light for an image display during the generation of an address discharge. A lower dielectric layer 215 is formed between the third electrodes 213 and the phosphors 214 to protect the third electrodes 213.

FIG. 2 illustrated only an example of the plasma display panel 100 applicable to an exemplary embodiment. Accordingly, an exemplary embodiment is not limited to the structure of the plasma display panel illustrated in FIG. 2.

For instance, in FIG. 2, the first electrode 202 and the second electrode 203 each include the transparent electrodes 202*a* and 203*a* and the bus electrodes 202*b* and 203*b*. However, at least one of the first electrode 202 and the second electrode 203 may include only the bus electrode.

Further, FIG. 2 illustrated the upper dielectric layer 204 having a constant thickness. However, the upper dielectric layer 204 may have a different thickness and a different dielectric constant in each area. FIG. 2 illustrated the barrier ribs 212 having a constant interval between the barrier ribs. However, an interval between the barrier ribs 112 forming the blue discharge cell (B) may be larger than intervals between the barrier ribs 112 forming the red and green discharge cells (R and G).

Further, a luminance of an image displayed on the plasma display panel 100 can increase by forming the side of the barrier rib 112 in a concavo-convex shape and coating the phosphor 214 depending on the concavo-convex shape of the barrier rib 112.

A tunnel may be formed on the side of the barrier rib 112 so as to improve an exhaust characteristic when the plasma display panel is fabricated.

Figure 3:
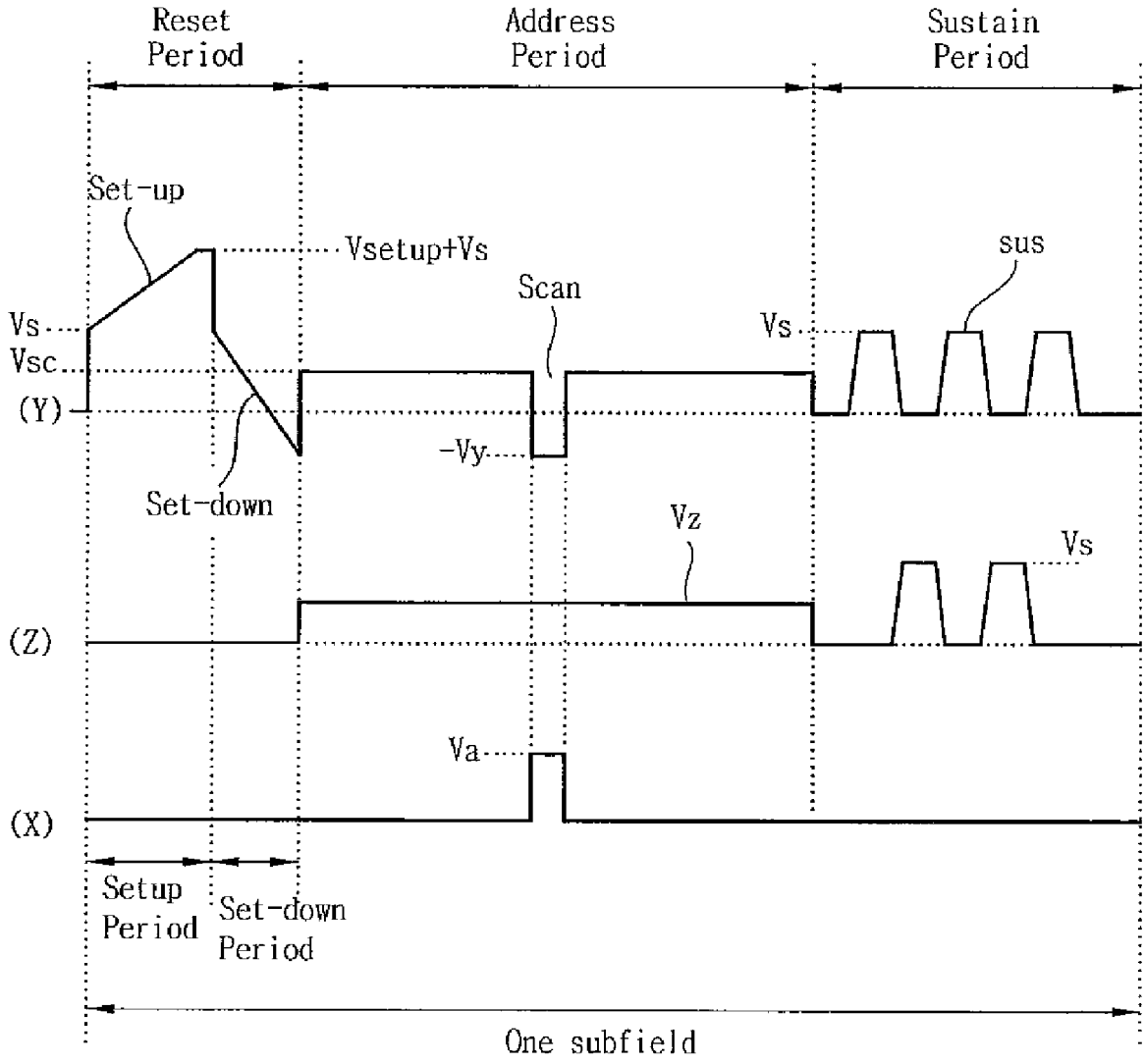
FIG. 3 illustrates a method of driving the plasma display apparatus of FIG. 1.

FIG. 3 illustrates a method of driving the plasma display apparatus of FIG. 1.

As illustrated in FIG. 3, the drivers 110, 120 and 130 of FIG. 1 supply driving signals to the first electrode Y, the second electrode Z, and the third electrode X during a reset period, an address period and a sustain period.

The reset period is divided into a setup period and a set-down period. During the setup period, a setup driver included in the first driver 110 may supply a setup signal (Set-up) to the first electrode Y. The setup signal (Set-up) generates a weak dark discharge within the discharge cells of the whole screen. This results in wall charges of a positive polarity being accumulated on the second electrode Z and the third electrode X, and wall charges of a negative polarity being accumulated on the first electrode Y.

During the set-down period, a set-down driver included in the first driver 110 may supply a set-down signal (Set-down), which falls from a positive voltage level lower than a highest voltage of the setup signal (Set-up) to a given voltage level lower than a ground level voltage GND, to the first electrode Y, thereby generating a weak erase discharge within the discharge cells. Furthermore, the remaining wall charges are uniform inside the discharge cells to the extent that the address discharge can be stably performed.

In FIG. 3, both the setup signal (Set-up) and the set-down signal (Set-down) are supplied during the reset period. However, instead of at least one of the setup signal (Set-up) and the set-down signal (Set-down), a bias signal maintained at a ground level voltage may be supplied. In a case of the setup signal (Set-up), a bias signal maintained at a sustain voltage of a sustain signal supplied to the first electrode Y or the second electrode Z during the sustain period may be supplied during the setup period.

During the address period, a scan reference voltage supply unit included in the first driver 110 may supply a scan reference voltage Vsc to the first electrode Y, and a scan signal supply unit included in the first driver 110 may supply a scan signal (Scan) of a negative polarity falling from the scan reference voltage Vsc to the first electrode Y. A data driver included in the third driver 130 may supply a data signal of a positive polarity corresponding to the scan signal (Scan) to the third electrode X. As a voltage difference between the scan signal (Scan) and the data signal is added to the wall voltage generated during the reset period, an address discharge occurs within the discharge cells to which the data signal is applied. Wall charges are formed inside the discharge cells selected by performing the address discharge to the extent that a discharge occurs whenever a sustain voltage Vs is applied. Hence, the first electrode Y is scanned.

In FIG. 3, the first driver 110 supplies the scan reference voltage Vsc to the first electrode Y during the address period. However, the first driver 110 may supply a scan bias voltage (Vsc-Vy) to the first electrode Y during the address period.

During the sustain period, a first sustain supply unit included in the first driver 110 and a second sustain supply unit included in the second driver 120 may alternately supply the sustain signal to the first electrode and the second electrode.

In FIG. 3, the sustain signals are alternately supplied to the first electrode and the second electrode. However, the sustain signals supplied to the first electrode and the second electrode may partially or wholly overlap each other.

Further, one half of the positive sustain voltage may be supplied to the first electrode Y, and one half of the negative sustain voltage may be supplied to the second electrode Z while one half of the positive sustain voltage is supplied to the first electrode Y.

During the sustain period, the first driver 110 may supply a sustain signal (sus) to the first electrode Y. As the wall voltage inside the discharge cells selected by performing the address discharge is added to the sustain signal (sus), every time the sustain signal (sus) is applied, a sustain discharge, i.e., a display discharge is generated between the first electrode Y and the second electrode Z.

An erase period may be added in an exemplary embodiment.

Figure 4:
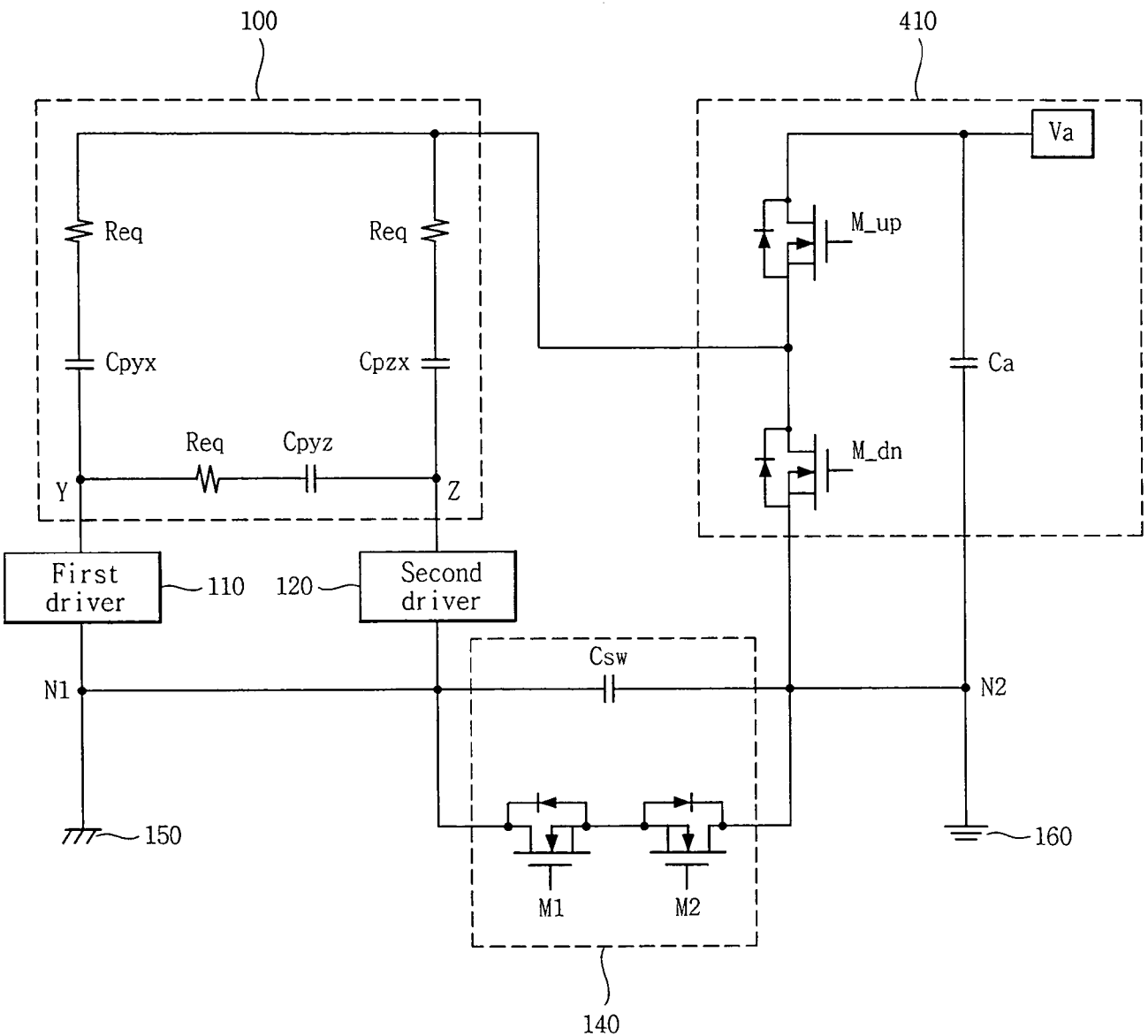
FIG. 4 illustrates an implementation of a separation controller.

FIG. 4 illustrates an implementation of a separation controller.

As illustrated in FIG. 4, the plasma display apparatus includes the plasma display panel 100, the first driver 110, the second driver 120, the third driver 130, and the separation controller 140.

As described above, the plasma display panel 100 includes a YZ capacitor Cpyz between the first electrode Y and the second electrode Z, a ZX capacitor Cpzx between the second electrode Z and the third electrode X, a YX capacitor Cpyx between the first electrode Y and the third electrode X, and an equivalent resistor Req with respect to the capacitors Cpyz, Cpzx and Cpyx.

One terminal of the first driver 110 is electrically connected to the first electrode Y, and the other terminal is electrically commonly connected to the first reference voltage source 150 and the separation controller 140.

The first driver 110 supplies the setup signal or the set-down signal during the reset period, and driving signals to the first electrode Y during the address period and the sustain period.

One terminal of the second driver 120 is electrically connected to the second electrode Z, and the other terminal is electrically commonly connected to the first reference voltage source 150 and the separation controller 140.

The second driver 120 supplies the sustain signal to the second electrode Z during the sustain period.

One terminal of the third driver 130 is electrically connected to the third electrode X, and the other terminal is electrically commonly connected to the second reference voltage source 160 and the separation controller 140.

The third driver 130 includes a data driver 410, and the data driver 410 includes a top switch M_up and a bottom switch M_dn.

The top switch M_up controls the supply of a data voltage of the data signal to the third electrode X during the address period. The bottom switch M_dn controls the supply of a second reference voltage output from the second reference voltage source 160 to the third electrode X during the address period.

The data driver 410 may not supply a driving signal to the third electrode X when the separation controller 140 is turned off.

When the separation controller 140 is turned off, the first driver 110 and the second driver 120 supply driving signals based on the first reference voltage source 150, and the third driver 130 supplies driving signals based on the second reference voltage source 160. The reason is to float the third electrode X.

In FIG. 4, the third driver 130 includes only the data driver 410. However, in the third driver 130, a plurality of switching elements may be used to supply the data voltage and a plurality of data signal supply sources may be used, and thus the data signal can rise to the data voltage over two or three-stage.

The separation controller 140 may include first and second switches M1 and M2 each having an internal diode. A forward direction of the internal diode of the first switch M1 may be opposite to a forward direction of the internal diode of the second switch M2. The reason is that when the internal diodes have the same forward direction, a current may flow into the internal diodes in spite of the fact that the first and second switches M1 and M2 are turned off.

The separation controller 140 may include a parasitic capacitor Csw parasitically generated in the first and second switches M1 and M2.

The separation controller 140 may separate the first reference voltage source 150 from the second reference voltage source 160 during at least one period of a reset period, an address period or a sustain period.

When the separation controller 140 separates the first reference voltage source 150 from the second reference voltage source 160, a first reference voltage output from the first reference voltage source 150 and a second reference voltage output from the second reference voltage source 160 are different from each other. Hence, the third electrode X is floated and a floating voltage of the third electrode X is obtained based on the first reference voltage source 150.

More specifically, a voltage between the first electrode Y and the second electrode Z changes depending on signals supplied by the first driver 110 and the second driver 120. In this case, a sum of voltages on a closed loop formed by the first electrode Y, the third electrode X, the second electrode Z, and the first electrode Y must be 0 due to Kirchhoffs Current Law (KCL). Therefore, a voltage between the first electrode Y and the third electrode X and a voltage between the second electrode Z and the third electrode X change.

A voltage of the third electrode X and a voltage between the first electrode Y and the second electrode Z change, and the voltage of the third electrode X changes to a floating voltage based on the first reference voltage source 150.

Since the voltage of the third electrode X changes to the floating voltage, an opposite discharge is suppressed. Accordingly, a contrast ratio is improved and a damage to the phosphor is prevented.

Figure 5:
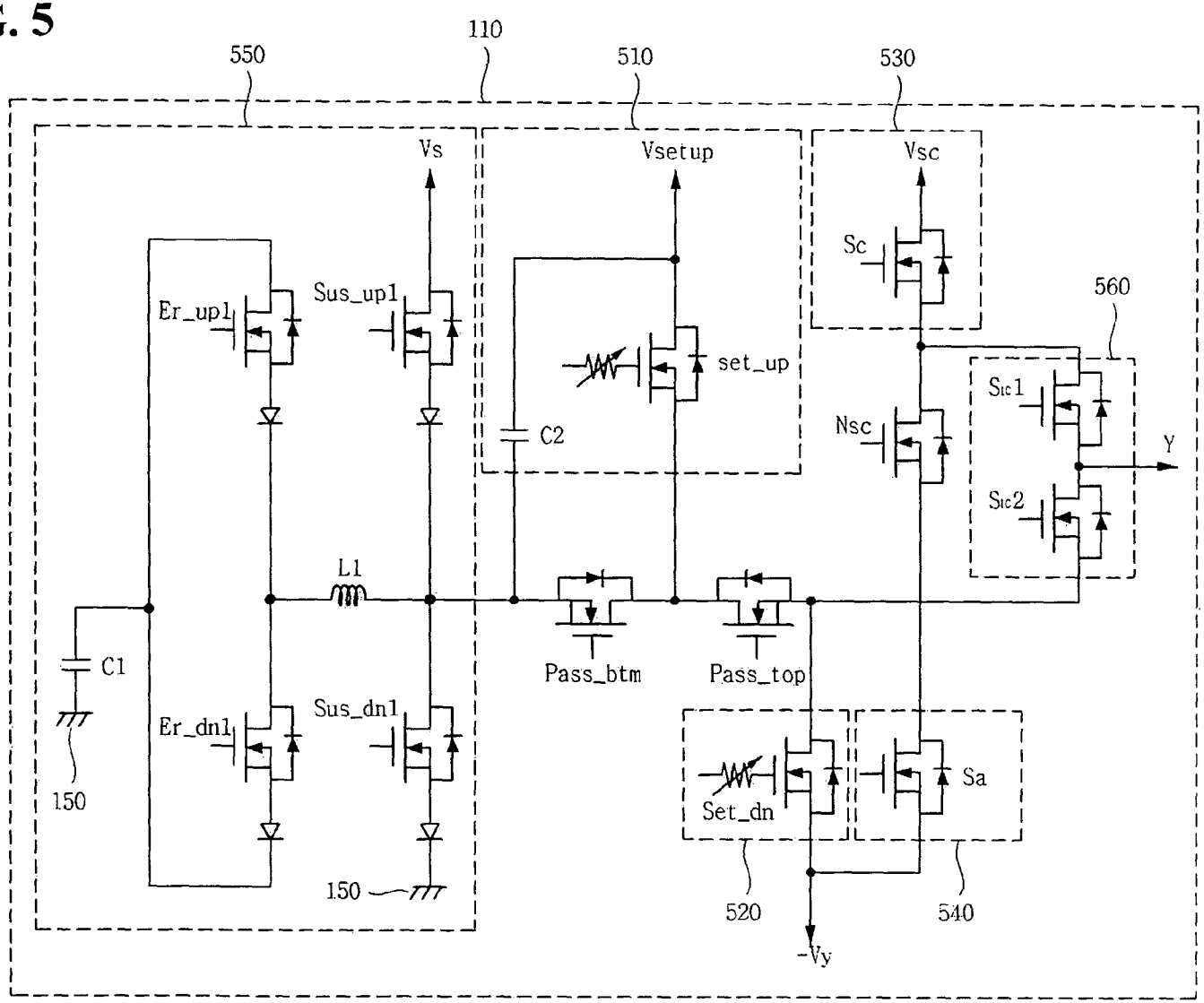
FIG. 5 illustrates a first driver of the plasma display apparatus of FIG. 4.

FIG. 5 illustrates a first driver of the plasma display apparatus of FIG. 4.

As illustrated in FIG. 5, the first driver 110 may include a setup supply unit 510, a set-down supply unit 520, a scan reference voltage supply unit 530, a scan signal supply unit 540, and a first sustain supply unit 550.

During a setup period, a setup switch (Set_up) and a switch Pass_top are turned on. Hence, the setup supply unit 510 supplies a gradually rising setup signal to the first electrode Y. Since a voltage Vs is charged to a second capacitor C2 before the reset period, both terminals of the setup switch (Set_up) have an equal voltage level. When the setup switch (Set_up) is turned on, the setup driver 510 supplies a setup signal gradually rising from the voltage Vs to a voltage (Vs+Vsetup) to the first electrode Y.

The setup signal may be supplied to the first electrode Y through one of a current path obtained by turning on an NSC switch and a SIC1 switch of a scan drive integrated circuit (IC) 560 or a current path obtained by turning on a SIC2 switch of the scan drive IC 560.

The current path of the signals supplied to the first electrode Y can be selected depending on switching operations of the NSC switch and the scan drive IC 560 during the remaining period except the address period. The reason is to reduce the heat generation of the scan drive IC 560.

During a set-down period, a set-down switch (Set_dn) of the set-down supply unit 520 is turned on. Hence, the set-down supply unit 520 supplies a gradually falling set-down signal to the first electrode Y.

During an address period, a scan reference voltage switch Sc of the scan reference voltage supply unit 530 is turned on. Hence, the scan reference voltage supply unit 530 supplies the scan reference voltage Vsc to the first electrode Y. Further, a scan signal switch Sa of the scan signal supply unit 540 is turned on. Hence, a scan signal falling from the scan reference voltage Vsc to a voltage −Vy is supplied to the first electrode Y.

During a sustain period, a first sustain switch Sus_up1 of the first sustain supply unit 550 is turned on. Hence, the sustain voltage Vs of the sustain signal is supplied to the first electrode Y. Then, a first falling switch Er_dn1 is turned on. Hence, as one half of the sustain voltage Vs is charged to a first capacitor C1 through resonance between a first inductor L1 and the panel 100, a voltage of the first electrode Y falls from the sustain voltage Vs to the first reference voltage.

Thereafter, a first ground switch Sus_dn1 is turned on. Hence, the first reference voltage is supplied to the first electrode Y. Then, a first rising switch Er_up1 is turned on. Hence, one half of the sustain voltage Vs charged to the first capacitor C1 is supplied to the first electrode Y through resonance between the first inductor L1 and the panel 100, and a voltage of the first electrode Y rises from the first reference voltage to the sustain voltage Vs.

During the sustain period, in case that a current path is formed so that the first sustain supply unit supplies a voltage to the first electrode Y, the switch Pass_top is turned on. In case that a current path is formed so that the first driver 110 receives a voltage from the first electrode Y, a switch Pass_btm is turned on.

A voltage source supplying the driving signals to the first sustain supply unit 550, for instance, a sustain voltage source (Vs), a setup voltage source (Vsetup), a scan reference voltage source (Vsc), and a scan signal voltage source (−Vy) are electrically connected to the first reference voltage source 150, and the first capacitor C1 and the first ground switch Sus_dn1 are electrically connected to the first reference voltage source 150. The reason is to supply stable driving signals to the first electrode Y without an influence of the electrical separation between the first reference voltage source 150 and the second reference voltage source 160.

Figure 6:
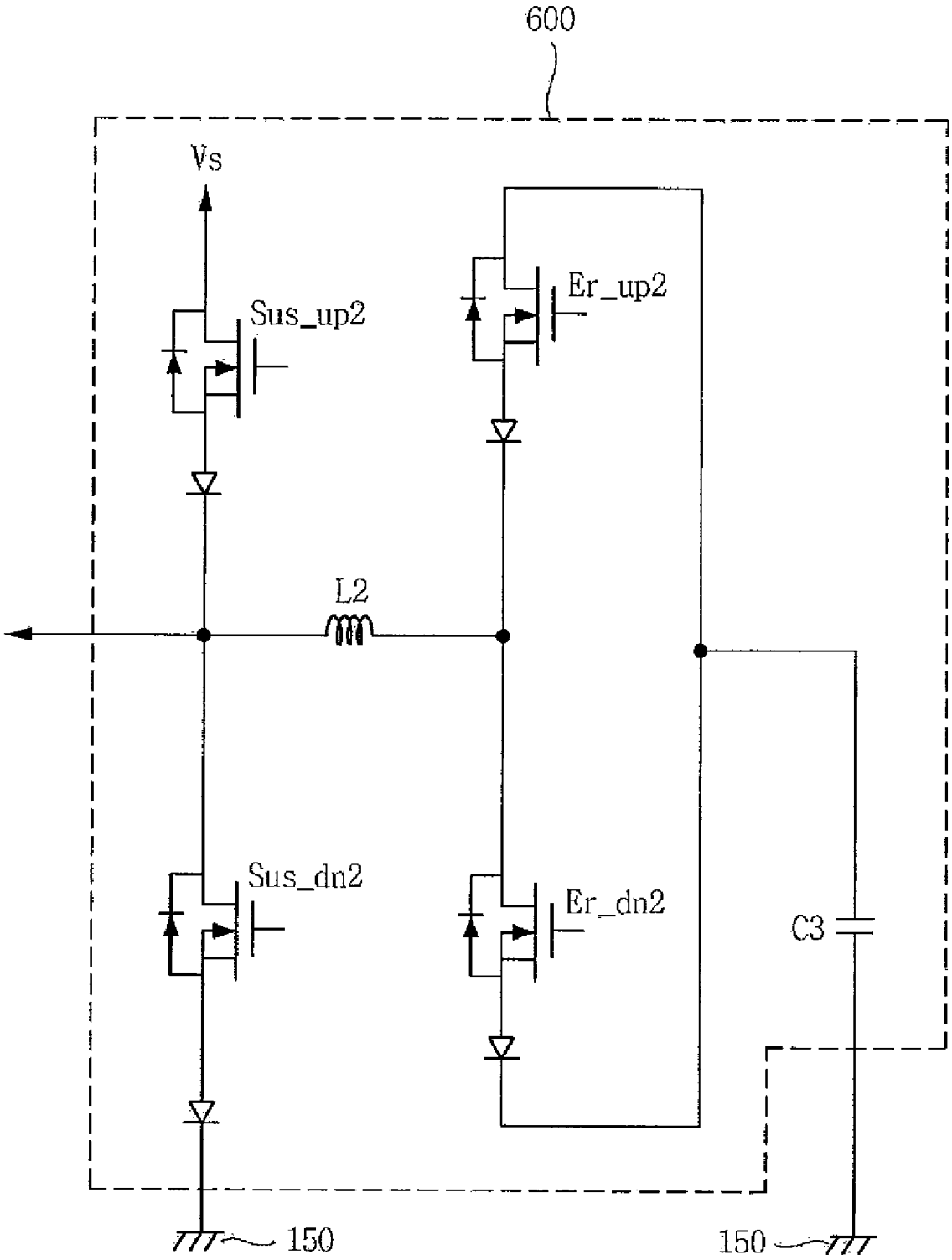
FIG. 6 illustrates a second driver of the plasma display apparatus of FIG. 4.

FIG. 6 illustrates a second driver of the plasma display apparatus of FIG. 4.

The second driver 120 include a second sustain supply unit 600.

The second sustain supply unit 600 supplies a sustain signal to the second electrode Z during the sustain period. The second sustain supply unit 600 includes a second sustain switch Sus_up2, a second inductor L2, a second falling switch Er_dn2, a second ground switch Sus_dn2, a second rising switch Er_up2, and a third capacitor C3.

Since an operation of the second sustain supply unit 600 is substantially the same as an operation of the first sustain supply unit 550, a description thereof is omitted.

A sustain voltage source Vs supplying a voltage to the second sustain supply unit 600 and the second ground switch Sus_dn2 are electrically connected to the first reference voltage source 150. The reason why the first driver 110 and the second driver 120 are connected to the first reference voltage source 150 is to supply stable driving signals to the first electrode Y and the second electrode Z during the reset, address and sustain periods.

Figure 7A:
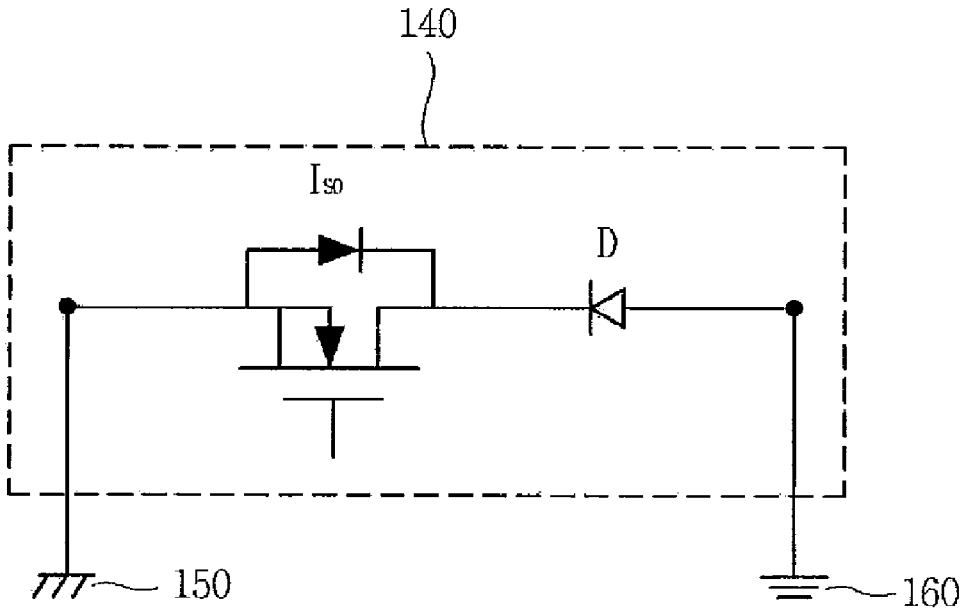
FIGS. 7A and 7B illustrate another implementation of a separation controller of the plasma display apparatus of FIG. 4.
Figure 7B:
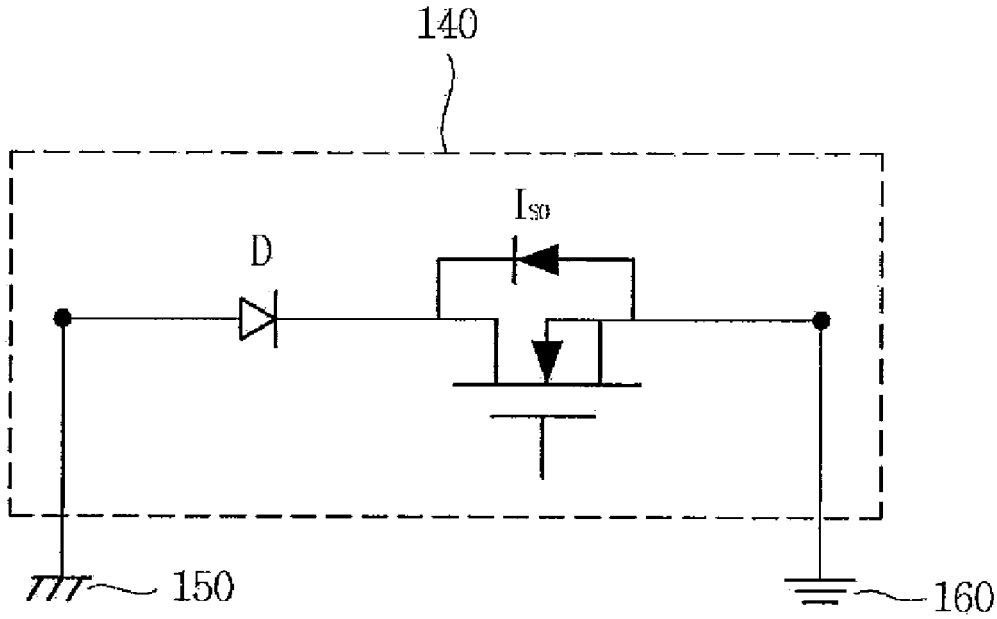

FIGS. 7A and 7B illustrate another implementation of a separation controller of the plasma display apparatus of FIG. 4.

As illustrated in FIG. 7A, one terminal of a separation controller switch Iso of the separation controller 140 is connected to the first reference voltage source 150, and the other terminal is connected to one terminal of a diode D. The other terminal of the diode D is connected to the second reference voltage source 160.

Otherwise, as illustrated in FIG. 7B, one terminal of the separation controller switch Iso is connected to the second reference voltage source 160 and the other terminal is connected to one terminal of the diode D. The other terminal of the diode D is connected to the first reference voltage source 150.

As above, since the diode D cheaper than a switch is used, the fabrication cost of the plasma display apparatus is reduced. Further, since only one switch Iso is used, the separation controller 140 can be controlled more easily.

Figure 8:
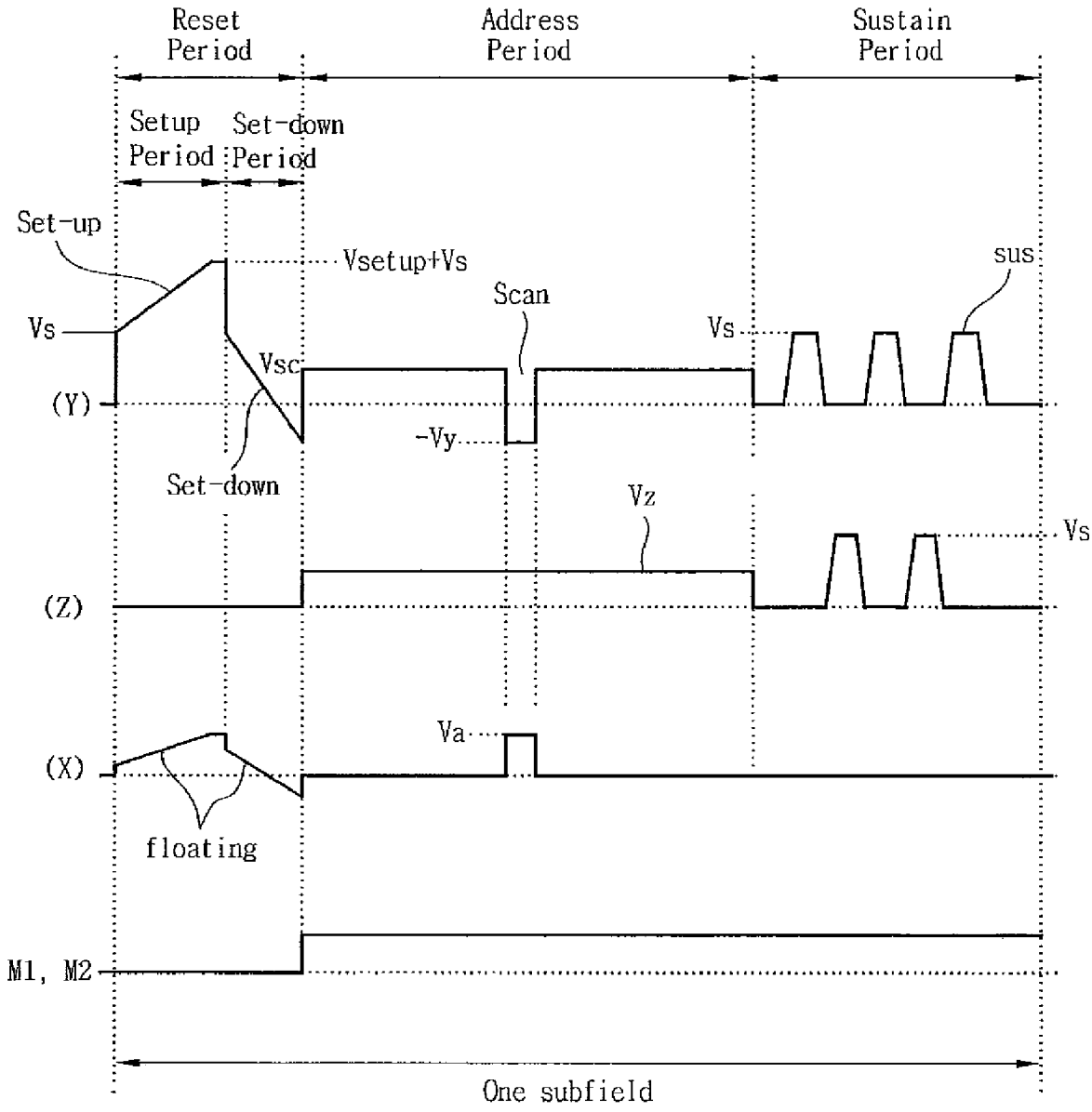
FIG. 8 illustrates the floating of a third electrode.

FIG. 8 illustrates the floating of a third electrode.

As illustrated in FIG. 8, the first driver 110 supplies driving signals to the first electrode Y during reset, address and sustain periods. The second driver 120 supplies driving signals to the second electrode Z during the address and sustain periods.

The first and second switches M1 and M2 of the separation controller 140 are turned off during the reset period. Hence, the first reference voltage source 150 is separated from the second reference voltage source 160. In this case, the third electrode X is floated.

More specifically, during the reset period, the first driver 110 connected to the first reference voltage source 150 supplies a setup signal (Set-up) and a set-down signal (Set-dn) to the first electrode Y. The second driver 120 supplies the first reference voltage output from the first reference voltage source 150 to the second electrode Z.

In this case, a voltage of the third electrode X changes depending on changes in a voltage between the first electrode Y and the second electrode Z, and the third electrode X is floated based on the first reference voltage source 150.

Since the third electrode X is floated during the reset period, an intensity of a dark discharge due to an opposite discharge generated during the reset period is reduced and a contrast ratio is improved.

Figure 9:
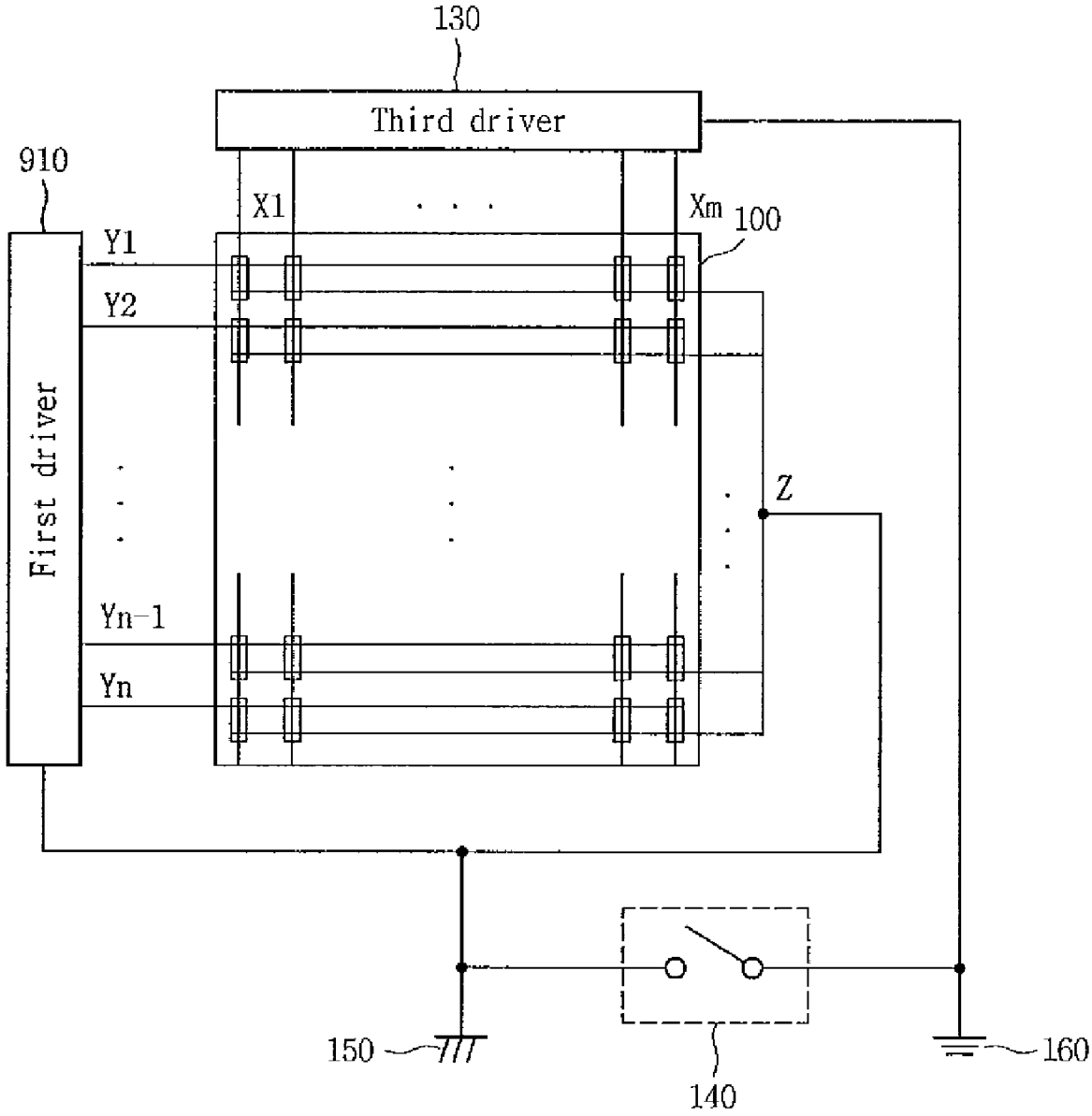
FIG. 9 illustrates another implementation of a plasma display apparatus according to an exemplary embodiment.

FIG. 9 illustrates another implementation of a plasma display apparatus according to an exemplary embodiment.

As illustrated in FIG. 9, the plasma display apparatus includes the plasma display panel 100 including the first electrodes Y1 to Yn, the second electrodes Z and the third electrodes X1 to Xm, a first driver 910, the third driver 130, and the separation controller 140.

The first driver 910 supplies a sustain signal including a positive sustain voltage and a negative sustain voltage to the first electrodes Y1 to Yn during a sustain period. A sustain driver included in the first driver 910 supplies the sustain signal. The second electrodes Z are electrically connected to the first reference voltage source 150.

As above, since a circuit for driving the second electrodes Z is removed, the first driver 910 supplies the sustain signal capable of generating a sustain discharge, thereby reducing the fabrication cost.

The first reference voltage source 150 may be a frame attached to a rear surface of the plasma display panel 100, or may be formed of a conductive material having a predetermined area. For instance, the first reference voltage source 150 may be a frame attached to a rear surface of the plasma display panel 100, or a conductive cooper foil having a predetermined area.

Since the plasma display panel 100, the third driver 130, and the first reference voltage source 150 was described above, a description thereof is omitted.

Figure 10:
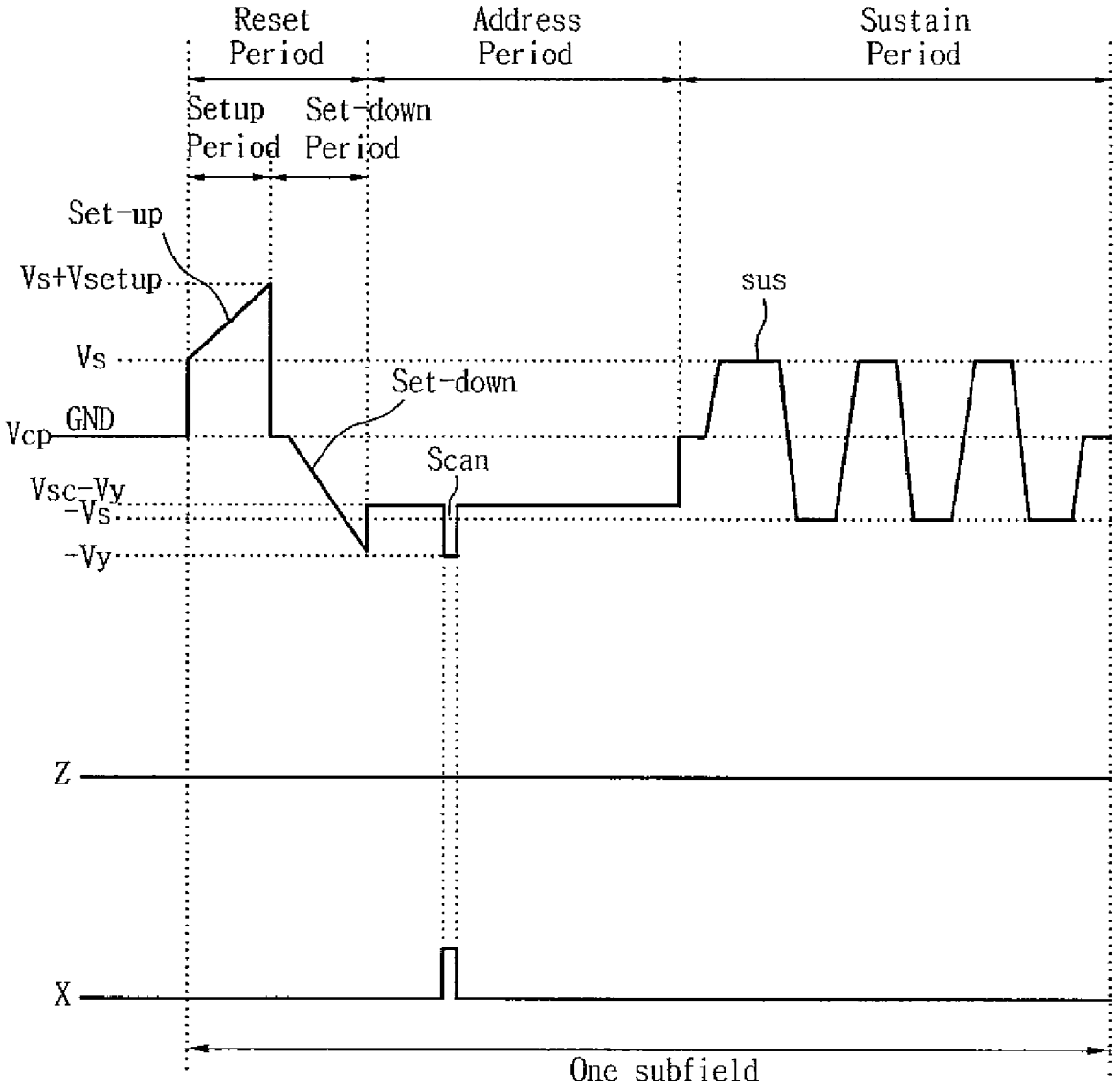
FIG. 10 illustrates a method of driving the plasma display apparatus of FIG. 9.

FIG. 10 illustrates a method of driving the plasma display apparatus of FIG. 9.

As illustrated in FIG. 10, the sustain driver included in the first driver 910 supplies a sustain signal (sus) including a positive sustain voltage +Vs and a negative sustain voltage −Vs to the first electrode Y during a sustain period, thereby generating a sustain discharge. A voltage of the second electrode Z electrically connected to the first reference voltage source 150 is maintained at the first reference voltage during one subfield.

Figure 12:
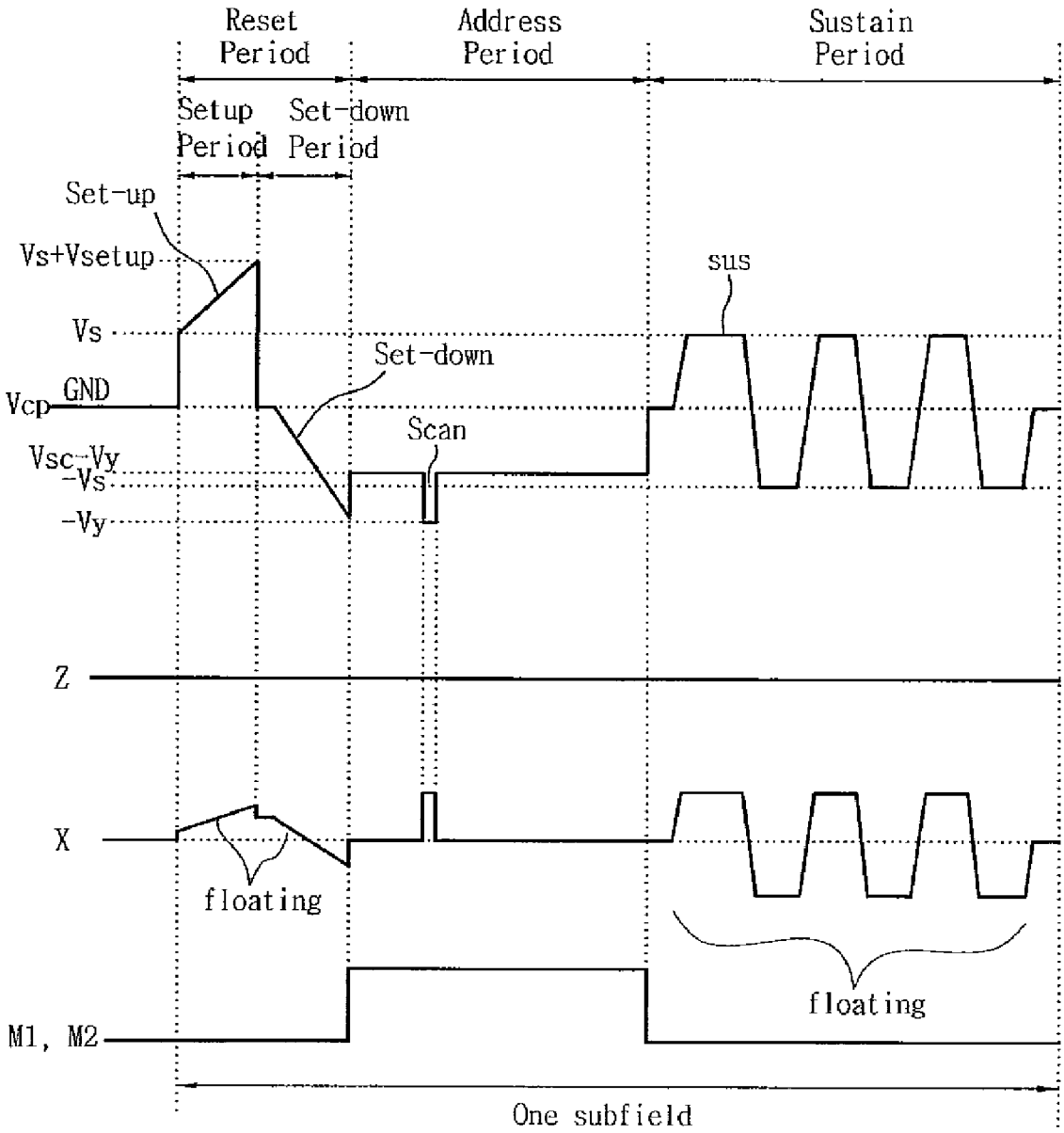
FIG. 12 illustrates another method of driving the plasma display apparatus of FIG. 9.

FIG. 10 illustrates a waveform in case that the first reference voltage source 150 is turned on during one subfield. FIG. 12 illustrates a waveform in case that the first reference voltage source 150 is turned off during one subfield.

Since a waveform during a reset period and an address period was described and illustrated in FIG. 3, a description thereof is omitted.

Figure 11:
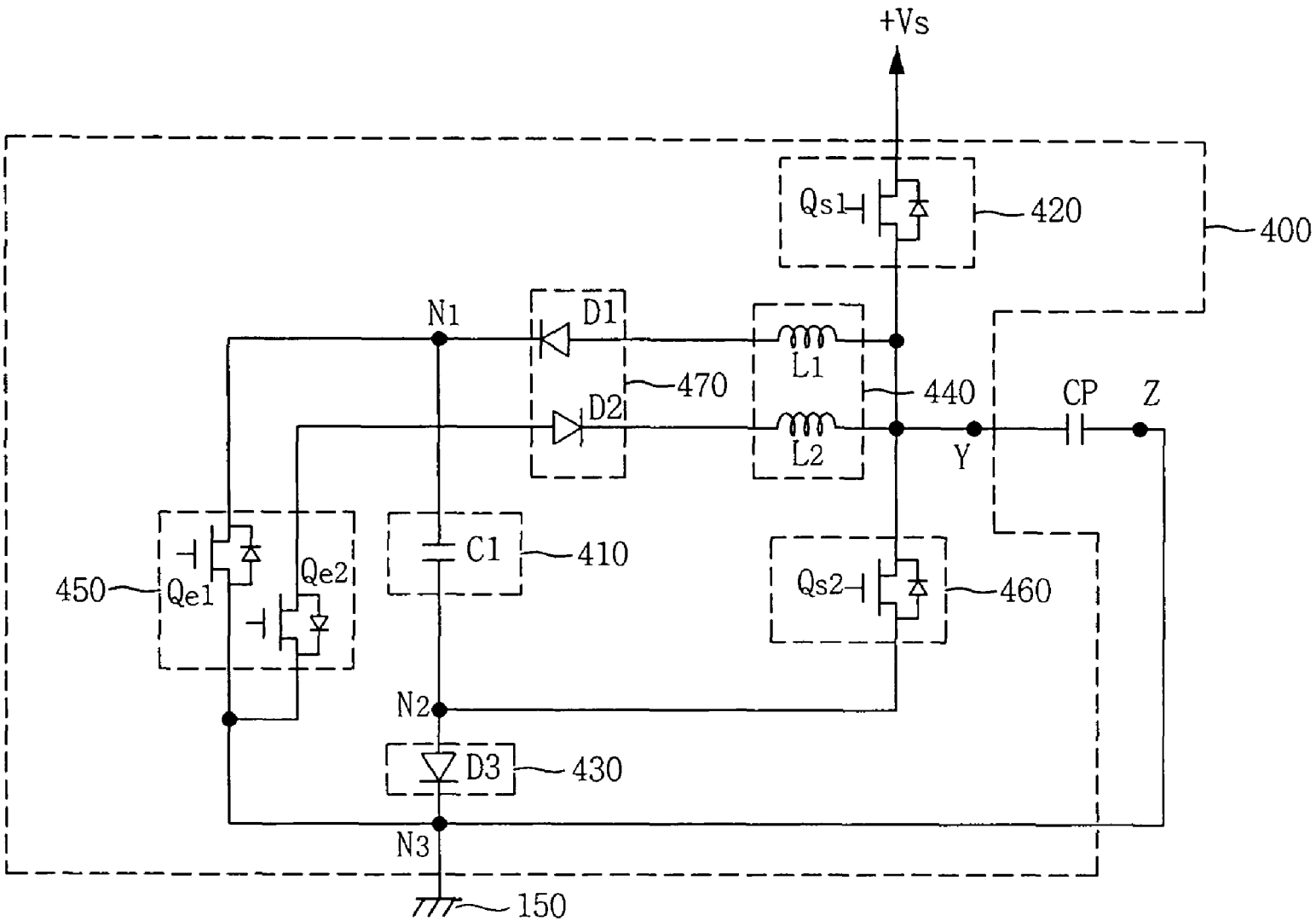
FIG. 11 illustrates a sustain driver included in a first driver of the plasma display apparatus of FIG. 9.

FIG. 11 illustrates a sustain driver included in a first driver of the plasma display apparatus of FIG. 9.

As illustrated in FIG. 11, a sustain driver 400 includes a capacitor unit 410, a first sustain controller 420, a voltage maintenance unit 430, an inductor unit 440, a resonance controller 450, a second sustain controller 460, and a reverse current blocking unit 470.

The capacitor unit 410 includes a capacitor C1 charging a voltage.

The first sustain controller 420 includes a first sustain switch Qs1. The first sustain controller 420 supplies a first voltage output from a positive voltage source +Vs to the scan electrode Y, and at the same time charges the first voltage to one terminal of the capacitor C1.

The voltage maintenance unit 430 includes a third diode D3, and prevents a reverse current to maintain a voltage charged to the capacitor C1.

The inductor unit 440 includes a first inductor L1 and a second inductor L2. The inductor unit 440 and the plasma display panel Cp form resonance. The first inductor L1 and the panel Cp form resonance so that a voltage of the first electrode Y changes from the first voltage to a second voltage lower than the first voltage. The second inductor L2 and the panel Cp form resonance so that a voltage of the first electrode Y changes from the second voltage to the first voltage.

The resonance controller 450 includes a first resonance switch Qe1 and a second resonance switch Qe2. The resonance controller 450 changes a voltage of the first electrode Y from the first voltage to the second voltage or from the second voltage to the first voltage through resonance between the inductor unit 440 and the panel Cp.

More specifically, the first resonance switch Qe1 controls a voltage of the first electrode Y to change from the first voltage to the second voltage through the resonance. The second resonance switch Qe2 controls a voltage of the first electrode Y to change from the second voltage to the first voltage through the resonance.

The second sustain controller 460 includes a second sustain switch Qs2. The second sustain controller 460 supplies the second voltage of the other terminal of the capacitor C1 to the first electrode Y, and thus a voltage of the first electrode Y is maintained at the second voltage.

The reverse current blocking unit 470 includes a first diode D1 and a second diode D2, and is electrically connected to the inductor unit 440 and the resonance controller 450 to block a reverse current. The first diode D1 blocks a current flowing from the first resonance switch Qe1 into the first inductor L1, and the second diode D2 blocks a reverse current flowing from the second inductor L2 into the second resonance switch Qe2.

Since the second electrode Z is electrically connected to the first reference voltage source 150, a voltage of the first reference voltage source 150 is supplied to the second electrode Z during the supply of the first voltage and the second voltage to the first electrode Y.

As above, since a separate driver for supplying the driving signals to the second electrode Z is not necessary, the fabrication cost is reduced.

A time period during which the first voltage is supplied to the first electrode Y and at the same time, the first voltage is charged to one terminal of the capacitor C1 may be longer than a time period during which the second voltage of the other terminal of the capacitor C1 is supplied to the first electrode Y.

Accordingly, although the sustain load increases, a voltage drop can be prevented by stably charging a voltage to the capacitor C1.

The sustain load means an increase in a load effect. The load effect means that as an average picture level (APL) increases, the number of sustain signals increases. The sustain load is prevented by setting a time period during which a voltage is charged to the capacitor to be longer than a time period during which a voltage is discharged from the capacitor.

An operation method of the sustain driver 400 will be described below.

First, the second resonance switch Qe2 and the first sustain switch Qs1 are turned on. Hence, a first current path I1 passing through the positive voltage source +Vs, the first sustain switch Qs1, the first inductor L1, the first diode D1, the capacitor C1, the third diode D3, and the first reference voltage source 150 is formed. Further, a second current path 12 passing through the positive voltage source +Vs, the first sustain switch Qs1, the panel Cp, and the first reference voltage source 150 is formed.

The positive sustain voltage output from the constant voltage source is charged to one terminal of the capacitor C1 through the first current path 11. Accordingly, although a voltage of one terminal or the other terminal of the capacitor C1 changes, a voltage of the capacitor C1 is maintained at a voltage charged thereto. For instance, in case that a voltage of one terminal of the capacitor C1 increases, a voltage of the other terminal of the capacitor C1 is maintained.

The positive sustain voltage is supplied to the first electrode Y through the second current path 12. A magnitude of the positive sustain voltage is substantially equal to a magnitude of a voltage capable of generating a sustain discharge inside the discharge cells.

Next, the first resonance switch Qe1 is turned on. Hence, a current path passing through the first electrode Y, the first inductor L1, the first diode D1, the first resonance switch Qe1, the first reference voltage source 150, and the second electrode Z is formed. The negative sustain voltage is supplied to the first electrode Y through the resonance between the first inductor L1 and the panel Cp.

Since both terminals of the capacitor C1 do not participate in the formation of the current path by the third diode D3, there in no change in a voltage stored in the capacitor C1.

A voltage of the first electrode Y falls from the positive sustain voltage +Vs to the negative sustain voltage −Vs based on the first reference voltage source 150.

As above, since a voltage of a first node N1 is 0V and a voltage of a second node N2 is maintained at a difference (i.e., the negative sustain voltage −Vs) between voltages charged to both terminals of the capacitor C1 in a state in which the voltage of the first electrode Y falls from the positive sustain voltage +Vs to the negative sustain voltage −Vs, a voltage of a third node N3 is 0V equal to the first reference voltage of the first reference voltage source 150.

The first resonance switch Qe1 and the second sustain switch Qs2 are turned on. Hence, a current path passing through the first electrode Y, the second sustain switch Qs2, the capacitor C1, the first resonance switch Qe1, the first reference voltage source 150, and the second electrode Z is formed.

Accordingly, a voltage of the first electrode Y is maintained at the negative sustain voltage −Vs based on the first reference voltage source 150. Since a voltage of the first node N1 is 0V based on the first reference voltage source 150 and a voltage of the second node N2 is maintained at a difference (i.e., the negative sustain voltage −Vs) between voltages charged to both terminals of the capacitor C1, a voltage of the third node N3 is 0V.

The voltage −Vs of the second node N2 is supplied to the first electrode Y through the second sustain switch Qs2.

In this case, the third diode D3 prevents the formation of a current path passing through the third node N3 and the second node N2. The reason is that the voltage of the third node N3 is higher than the voltage of the second node N2. In this case, a voltage of the second electrode Z is 0V equal to the first reference voltage of the first reference voltage source 150.

The second resonance switch Qe2 is turned on. Hence, a current path passing through the second electrode Z, the first reference voltage source 150, the second resonance switch Qe2, the second diode D2, the second inductor L2, and the first electrode Y is formed.

The positive sustain voltage +Vs is supplied to the first electrode Y through the resonance between the second inductor L2 and the panel Cp. Further, a voltage of the first electrode Y rises from the negative sustain voltage −Vs to the positive sustain voltage +Vs based on the first reference voltage source 150.

FIG. 12 illustrates another method of driving the plasma display apparatus of FIG. 9.

As illustrated in FIG. 12, the first driver 910 supplies driving signals to the first electrode Y during reset period, address period, and sustain period.

The first driver 910 supplies a sustain signal (sus) including the positive sustain voltage +Vs and the negative sustain voltage −Vs to the first electrode Y during the sustain period.

The first and second switches M1 and M2 of the separation controller 140 are turned off during the sustain period, and thus the first reference voltage source 150 is separated from the second reference voltage source 160. In this case, a signal similar to the sustain signal (sus) including the positive sustain voltage +Vs and the negative sustain voltage −Vs is supplied to the third electrode X.

More specifically, during the sustain period, the first driver 910 connected to the first reference voltage source 150 supplies the sustain signal (sus) to the first electrode Y, and a voltage of the second electrode Z connected to the first reference voltage source 150 is maintained at the first reference voltage.

A voltage of the third electrode X changes depending on changes in a voltage of the first electrode Y, and the third electrode X is floated based on the first reference voltage source 150.

As above, since the third electrode X is floated during the sustain period, an opposite discharge can be reduced due to a floating voltage of the third electrode X during the generation of a sustain discharge and a damage to the phosphor caused by the opposite discharge can be suppressed.

The first and second switches M1 and M2 of the separation controller 140 are turned off during the reset period, and thus the first reference voltage source 150 is separated from the second reference voltage source 160. In this case, since the third electrode X is floated during the reset period, an opposite discharge can be reduced due to a floating voltage of the third electrode X during reset period and a contrast ratio can be improved.

In an exemplary embodiment, the separation controller 140 is turned off during the reset period and the sustain period and thus the first reference voltage source 150 is separated from the second reference voltage source 160. Hence, the third electrode X is floated during the reset period and the sustain period. However, the separation controller 140 may be turned off during the address period so that the third electrode X is floated during the address period. An exemplary embodiment may be changed variously.

The data driver included in the third driver supplies the data signal that rises to the data voltage at a time. However, the data signal may rise to one half of the data voltage, and then rise from one half of the data voltage to the data voltage.

At least one of the setup signal or the set-down signal may be maintained at the first reference voltage of the first reference voltage source 150.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel including a first electrode, a second electrode, and a third electrode positioned in an intersection direction of the first electrode and the second electrode;

a first driver that supplies a driving signal to the first electrode during a reset period, an address period and a sustain period, and is electrically connected to a first reference voltage source;

a third driver that supplies a data signal to the third electrode during the address period, and is electrically connected to a second reference voltage source; and a separation controller that controls the electrical separation between the first reference voltage source and the second reference voltage source during at least one period of the reset period, the address period or the sustain period.

2. The plasma display apparatus of claim 1, further comprising a second driver that supplies a driving signal to the second electrode during the address period and the sustain period, and is electrically connected to the first reference voltage source.

3. The plasma display apparatus of claim 2, wherein the separation controller controls the electrical separation between the first reference voltage source and the second reference voltage source during the reset period.

4. The plasma display apparatus of claim 2, wherein the first driver includes:

a setup driver that supplies a gradually rising signal to the first electrode during the reset period;

a set-down driver that supplies a gradually falling signal to the first electrode during the reset period;

a scan reference voltage supply unit that supplies a scan reference voltage to the first electrode during the address period;

a scan signal supply unit that supplies a scan signal to the first electrode during the address period;

a first sustain supply unit that supplies a sustain signal to the first electrode during the sustain period; and a second sustain supply unit that supplies a sustain signal to the second electrode during the sustain period.

5. The plasma display apparatus of claim 2, wherein the third driver includes a data driver supplying the data signal to the third electrode, and the data driver includes a top switch supplying a data voltage of the data signal to the third electrode during the address period, and a bottom switch supplying a second reference voltage output from the second reference voltage source to the third electrode during the address period.

6. The plasma display apparatus of claim 2, wherein the separation controller includes a first switch whose one terminal is electrically connected to the first reference voltage source, and a second switch whose one terminal is electrically connected to the first switch and the other terminal is electrically connected to the second reference voltage source.

7. The plasma display apparatus of claim 6, wherein the first and second switches each include an internal diode, and a forward direction of the internal diode of the first switch is opposite to a forward direction of the internal diode of the second switch.

8. The plasma display apparatus of claim 2, wherein the separation controller includes a separation control switch whose one terminal is electrically connected to the first reference voltage source, and a diode whose one terminal is electrically connected to the other terminal of the separation control switch and the other terminal is electrically connected to the second reference voltage source.

9. The plasma display apparatus of claim 8, wherein the separation control switch includes an internal diode, and a forward direction of the internal diode of the separation control switch is opposite to a forward direction of the diode.

10. The plasma display apparatus of claim 2, wherein the separation controller includes a separation control switch whose one terminal is electrically connected to the second reference voltage source, and a diode whose one terminal is electrically connected to the other terminal of the separation control switch and the other terminal is electrically connected to the first reference voltage source.

11. The plasma display apparatus of claim 10, wherein the separation control switch includes an internal diode, and a forward direction of the internal diode of the separation control switch is opposite to a forward direction of the diode.

12. The plasma display apparatus of claim 1, wherein the first driver supplies a sustain signal including a positive sustain voltage and a negative sustain voltage to the first electrode during the sustain period.

13. The plasma display apparatus of claim 12, wherein the separation controller controls the electrical separation between the first reference voltage source and the second reference voltage source during the reset period and the sustain period.

14. The plasma display apparatus of claim 12, wherein the third driver includes a data driver supplying the data signal to the third electrode, and the data driver includes a top switch supplying a data voltage of the data signal to the third electrode during the address period, and a bottom switch supplying a second reference voltage output from the second reference voltage source to the third electrode during the address period.

15. The plasma display apparatus of claim 12, wherein the separation controller includes a first switch whose one terminal is electrically connected to the first reference voltage source, and a second switch whose one terminal is electrically connected to the first switch and the other terminal is electrically connected to the second reference voltage source.

16. The plasma display apparatus of claim 15, wherein the first and second switches each include an internal diode, and a forward direction of the internal diode of the first switch is opposite to a forward direction of the internal diode of the second switch.

17. The plasma display apparatus of claim 12, wherein the separation controller includes a separation control switch whose one terminal is electrically connected to the first reference voltage source, and a diode whose one terminal is electrically connected to the other terminal of the separation control switch and the other terminal is electrically connected to the second reference voltage source.

18. The plasma display apparatus of claim 17, wherein the separation control switch includes an internal diode, and a forward direction of the internal diode of the separation control switch is opposite to a forward direction of the diode.

19. The plasma display apparatus of claim 12, wherein the separation controller includes a separation control switch whose one terminal is electrically connected to the second reference voltage source, and a diode whose one terminal is electrically connected to the other terminal of the separation control switch and the other terminal is electrically connected to the first reference voltage source.

20. The plasma display apparatus of claim 19, wherein the separation control switch includes an internal diode, and a forward direction of the internal diode of the separation control switch is opposite to a forward direction of the diode.

* * * * *